US009095222B2

(12) United States Patent
Asaf et al.

(10) Patent No.: US 9,095,222 B2
(45) Date of Patent: Aug. 4, 2015

(54) BEDSIDE STORAGE CADDY

(71) Applicants: Amikam Asaf, Las Vegas, NV (US); Beth Asaf, Las Vegas, NV (US)

(72) Inventors: Amikam Asaf, Las Vegas, NV (US); Beth Asaf, Las Vegas, NV (US)

( * ) Notice: Subject to any disclaimer, the term of this patent is extended or adjusted under 35 U.S.C. 154(b) by 0 days.

(21) Appl. No.: 13/899,066

(22) Filed: May 21, 2013

(65) Prior Publication Data

US 2013/0305451 A1 Nov. 21, 2013

Related U.S. Application Data

(60) Provisional application No. 61/649,481, filed on May 21, 2012.

(51) Int. Cl.
*A47C 21/00* (2006.01)
*A61G 7/05* (2006.01)

(52) U.S. Cl.
CPC ..... *A47C 21/00* (2013.01); *A61G 7/0503* (2013.01); *A61G 2007/0522* (2013.01); *A61G 2203/80* (2013.01)

(58) Field of Classification Search
CPC ..... A47C 31/00; A47C 19/22; A47C 7/70; A47C 21/00; A61G 7/0503; A61G 7/05; A61G 13/107; A61G 7/0507; A61G 13/10; A61M 2202/0208; A61M 25/02; F16M 11/04; H01R 2201/12; H01R 35/00; A47B 97/00; A47G 29/08
USPC ..... 5/503.1, 658; 211/13.1, 85.13, 113, 211/119.004, 119.006, 119.007; 224/584, 224/275, 411; 383/24, 39
See application file for complete search history.

(56) References Cited

U.S. PATENT DOCUMENTS

| | | | | |
|---|---|---|---|---|
| 598,895 | A | 2/1898 | Bell | |
| 1,176,598 | A * | 3/1916 | Pollgreen | 190/111 |
| 1,291,914 | A * | 1/1919 | Kelley | 190/111 |
| 1,841,264 | A | 1/1932 | Horner | |
| 2,761,481 | A | 9/1956 | Boatwright | |
| 3,919,615 | A * | 11/1975 | Niecke | 320/112 |
| 3,967,666 | A * | 7/1976 | Farrar | 383/7 |
| 4,077,520 | A * | 3/1978 | Stevenson | 211/55 |
| 4,235,350 | A * | 11/1980 | Valentino | 220/495.1 |
| 4,431,154 | A | 2/1984 | Hamm | |
| 4,484,367 | A | 11/1984 | Jenkins | |
| 4,504,992 | A | 3/1985 | Herron et al. | |
| 4,672,703 | A | 6/1987 | Frazier | |
| 4,718,524 | A * | 1/1988 | Crumley | 190/110 |
| D294,757 | S * | 3/1988 | Kahane et al. | D32/36 |
| 4,796,790 | A * | 1/1989 | Hamilton | 224/675 |
| 4,954,561 | A | 9/1990 | Gerkin et al. | |
| 4,998,700 | A | 3/1991 | McKaig | |
| 5,365,623 | A | 11/1994 | Springer | |

(Continued)

*Primary Examiner* — Peter M Cuomo
*Assistant Examiner* — Eric Kurilla

(57) ABSTRACT

A bedside storage caddy includes a flexible panel attached to a rigid backplate, as well as a first flexible strap and a second flexible strap from which the flexible panel is suspended. Positioned on the flexible panel are a plurality of guide rings and a plurality of pockets. The plurality of pockets, formed from a base, a pocket wall, an interior lip, an upper lip, and an opening, allowing the bedside storage caddy to hold personal items, such as cell phones and glasses. The interior lip and the upper lip prevent these items from accidently slipping out of the pocket. The first flexible strap and the second flexible strap each have a plurality of eyelets and a stud, positioned on opposite ends of a strap body. The stud engages with an arbitrary eyelet, allowing the straps to be secured around the railing of a hospital bed.

6 Claims, 10 Drawing Sheets

(56) References Cited

U.S. PATENT DOCUMENTS

| | | | | |
|---|---|---|---|---|
| 5,370,246 | A | 12/1994 | Traynor | |
| 5,581,829 | A | 12/1996 | Lee | |
| 5,651,152 | A | 7/1997 | Ritchie et al. | |
| D402,840 | S * | 12/1998 | Servis | D6/553 |
| D420,510 | S | 2/2000 | Rotan | |
| 6,148,459 | A * | 11/2000 | Verhulst | 5/503.1 |
| 6,253,399 | B1 | 7/2001 | Wagner | |
| 6,292,963 | B1 | 9/2001 | Couture | |
| 6,336,555 | B1 * | 1/2002 | Breeden | 206/371 |
| D487,635 | S * | 3/2004 | Collins | D3/315 |
| 6,848,132 | B1 | 2/2005 | Dale | |
| D522,750 | S | 6/2006 | Girod | |
| 7,438,194 | B2 * | 10/2008 | Wang | 211/113 |
| 7,621,009 | B2 * | 11/2009 | Elhabashy | 5/622 |
| D607,255 | S * | 1/2010 | Sunseri | D6/571 |
| D636,997 | S * | 5/2011 | DeVoe | D3/303 |
| 2010/0325805 | A1 * | 12/2010 | Kraus et al. | 5/662 |

* cited by examiner

BEDSIDE STORAGE CADDY

The current application claims a priority to the U.S. Provisional Patent application Ser. No. 61/649,481 filed on May 21, 2012.

FIELD OF THE INVENTION

The present invention relates generally to an apparatus. More specifically, the present invention relates to an article storage caddy which is attached to a hospital bed side railing and relates to a storage caddy which can be quickly and easily installed to or removed from a patient hospital bed railing. The present invention allows convenient placement of small articles or necessities within the patient's reach and is capable of holding personal items in any position of the bed side railing.

BACKGROUND OF THE INVENTION

For many years when a person has a medical condition which requires them to spend time in a hospital, skilled nursing facility, nursing home, convalescent facilities and the like, they frequently bring with them personal needed articles from home. There are only very few convenient places to put or store such items in a hospital room environment. When a small table next to the bed is provided, it is often cluttered with hospital food trays and other hospital related items which may be moved intentionally or unintentionally by any other hospital staff member at any time. Additionally, in today's hospital reality, a patient may move from one room to another with very short notice, in which case their personal belongings are liable to get misplaced during the move. Additionally, a person staying in the hospital may have items of personal value which they wish to have in close proximity to them. Although most hospitals have centrally located safes, there is no place for a patient confined to the bed to keep those articles safe and in immediate reach as they wish. In this situation usually the patient will use the nursing call light button, distract the CNA (certified nursing assistant), nurse or any other team member worker from doing other important medical duties which might be more crucial to the well being of other patients. Therefore, there has been a recognized need for many years, to provide convenient and safe bedside storage of those patient's necessities and amenities that is easy to reach or store while they are in the hospital.

For many years inventors and patients in the hospital have tried to come up with different solutions for this problem. Every generation has introduced different situations and conditions, using different type of beds and railings, different articles that appear as we move along with all the newer (and smaller) developed items. In recent years, our society uses certain items that have become not only convenient, but almost a necessity.

Today when a person has a medical problem which requires him or her to spend time in the hospital or a like, they frequently bring with them personal items such as cell phones, eye glasses, hearing aids, dentures, and the like. Today most of the patients have at least one of the above items, and most of the time more than one. These articles are a necessity for patients to be able to continue to function with their lives as normal as possible (to be able to chew and eat, hear, see, read and communicate with family, friends, doctors, and others). These things are not luxury items any more, but necessary for the daily activity of the patient. If any of these articles are lost during the patient's stay in the hospital, they can become very hard to replace in a timely manner. Any one of these items can easily cost a few hundred dollars to a few thousand dollars. If any of these articles are missing, this is going to be a devastating situation for the patient and the family.

The bed railing needs to have the ability to be at least in two positions: an up position when the patient lies down in the bed, and a down position when the patient gets in or out of the bed, or when the CNA or the nurse needs to change the linens or to have access to the upper body of the patient for a variety of needed treatments. When this happens, if all of the article caddy is inside the railing, close to the patient's reach as needed, it will be impossible to lower the rail in the way it was designed in the hospital beds today. None of the prior art have been able to address this issue.

It is therefore an object of the present invention to provide an improved patient article caddy for hospital beds of the type which is suspended from a patient bed railing. The present invention provides convenient and secured storage for miscellaneous articles that a patient might need to bring from home when admitted to the hospital. The ability of the article caddy to be in a position inside or outside of the hospital bed railing (depending on configuration of the railing) will address the main issues of safely storing the patient's articles at any position of the railing and the ability to move the railing to an up or down position without the article caddy being in the way or falling off the railing.

It is a further object of the present invention to provide an article caddy which is installed to the bed side railing in such a way that it does not slide away from the patient when the head end of the bed and the corresponding side railing of the hospital bed is raised.

It is a further object of the present invention to provide an article caddy which can easily be removed from one bed side railing and reinstalled on another bed side railing for easy transfer along with the patient and provide a low cost, disposable article caddy.

It is a further object of the present invention to provide an article caddy which can easily store articles such as cell phone, eyeglasses, or hearing aids, and allow the articles to be picked up with the use of only one hand.

BRIEF DESCRIPTION OF THE PRIOR ART

For many years there has been a recognized need to provide convenient bedside storage of small necessities and amenities while people stay in the hospital. Over the years inventors have designed various solutions in response to new articles and specific needs. Over the years various trays, holders with clips, clamps or others have been designed to engage bed and bed railing, as disclosed in other US patents. These designs go back many years as far as Feb. 15, 1898 with U.S. Pat. No. 598,895 by Joseph Bell of Flora, Ind., which is especially designed for use in sick-rooms and to solve a problem for that time.

U.S. Pat. No. 1,841,264 from 1932 was developed to solve another problem that arose around that time. Other US patents followed over the years as disclosed in US patents numbers provided at the section related application. U.S. Pat. Nos. 4,431,154, 4,484,367, 4,504,992, 4,672,703, 4,954,561, 4,998,700, 5,365,623, U.S. Pat. No. 6,253,399 B1 all have tried to come up with solution for holding and storing different apparatuses as a nurse call device, electrical device, hospital telephone and a like. All of these attached to the bed side railing. Other patents were developed to address more specific needs of storing different belongings, small and big articles that a patient might have during the hospital stay as U.S. Pat. No. 5,651,152. Other U.S. Pat. No. 5,581,829, U.S.

Pat. No. 6,292,963 B1, U.S. Pat. No. 6,848,132 B1 are not using the bed railing but the mattress or the sheets. The last group of patents, and more specifically U.S. Pat. No. Des. 420,510, U.S. Pat. No. D522,750S, U.S. Pat. No. 2,761,481, U.S. Pat. No. 3,967,666, and U.S. Pat. No. 5,370,246 came to address the patient's needs to store small articles that patients might bring from home, using a caddy attached to hospital bed railing.

As shown in the list above of other solutions, many inventors designed various solutions in response to specific needs. However, the prior art have certain drawbacks. Most of them, because of the attachment means, can be use only with certain types of bed railing. Almost no single device of the above caddies can be universally used with the various types of hospital bed railings. Part of the prior art patents as U.S. Pat. No. 5,651,152 lacked the ability to be easily removed and reinstalled to allow them to transfer with the patient from one unit to other and to fit on other types of bed railings, which happens many times in the hospital. Additionally, the cost of these holders is generally prohibitive for disposable usage. The bedside article storage caddy disclosed in U.S. Pat. No. 2,761,481 (1954), U.S. Pat. No. 3,967,666 (1975), and U.S. Pat. No. 5,370,246 (1994) recognized and addressed some of the concerns with the previously discussed caddies. All of them still will have the problem to fit on as many types of hospital bed railings that are in the market today. They also do not address more specifically the patient's needs that have developed over the last 20 years or so. But the foremost important issue is that all of the patents that have designed over the years did not deal with or even mention one of the major problems that arise when using the bed railing as a support apparatus, which is the need for the article caddy to allow the bed railing to be switched between an up position and a down position.

DETAIL DESCRIPTIONS OF THE INVENTION

All illustrations of the drawings are for the purpose of describing selected versions of the present invention and are not intended to limit the scope of the present invention.

Figure 1:
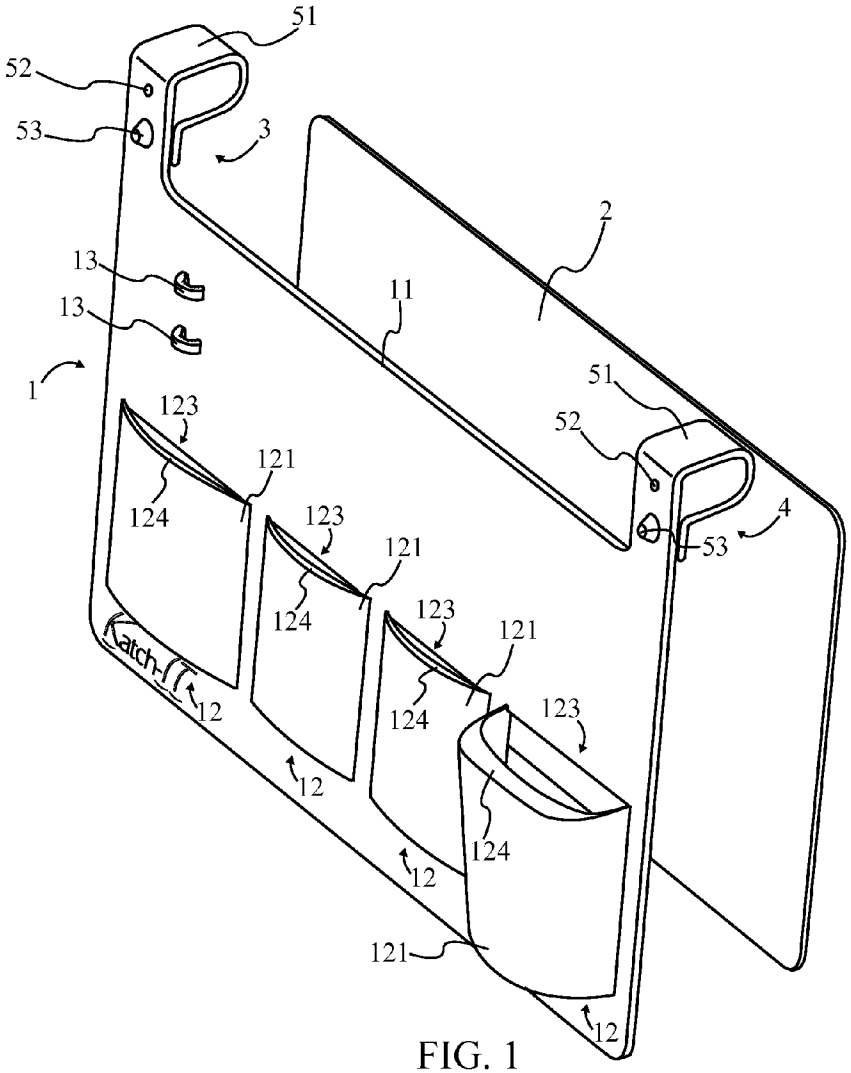
FIG. 1 is an exploded perspective view showing a flexible panel, a first flexible strap, a second flexible strap, and a rigid backplate of the present invention.
Figure 2:
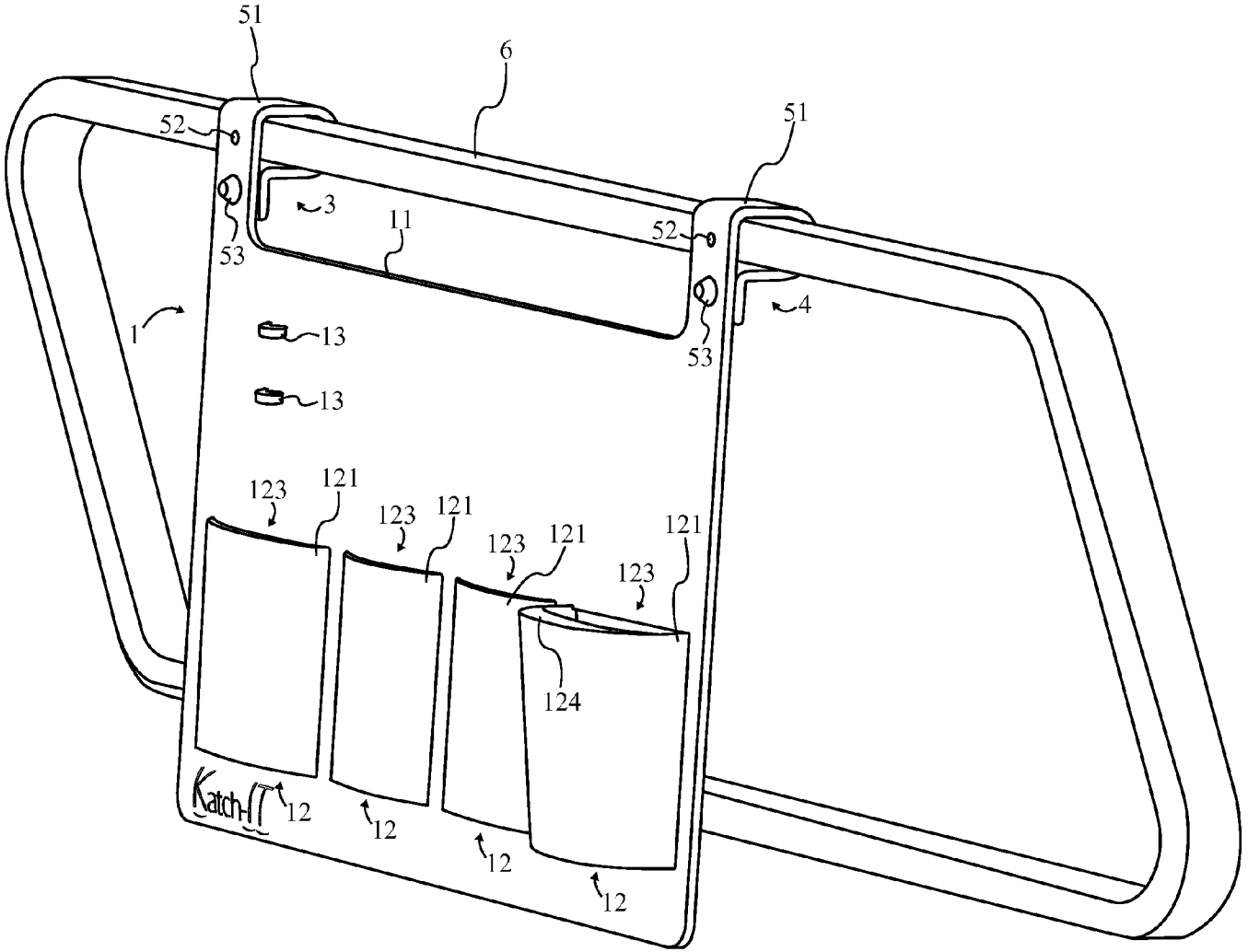
FIG. 2 is a perspective view showing the first flexible strap and the second flexible strap of the present invention secured to a railing.
Figure 3:
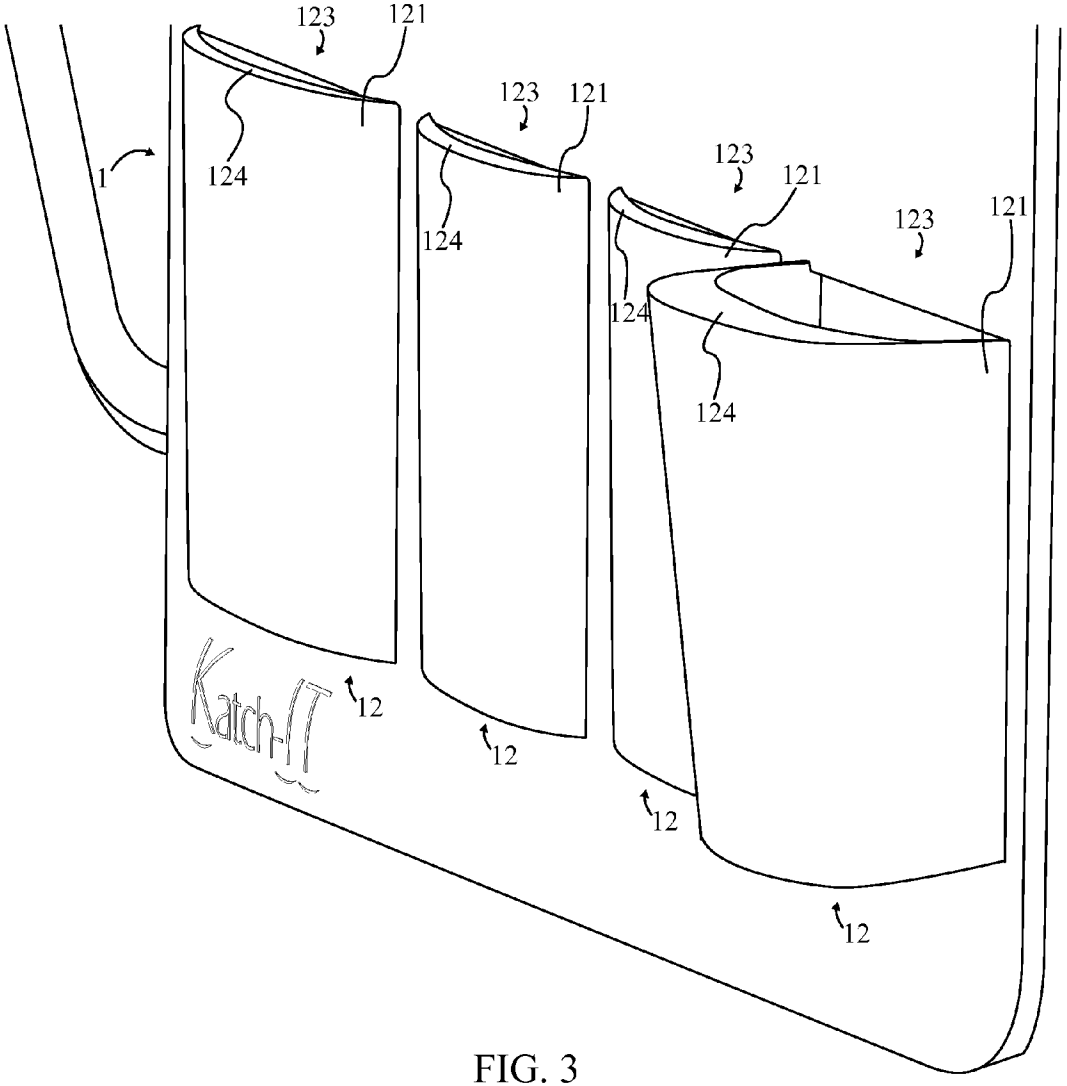
FIG. 3 is a perspective view showing a plurality of pockets of the present invention.
Figure 4:
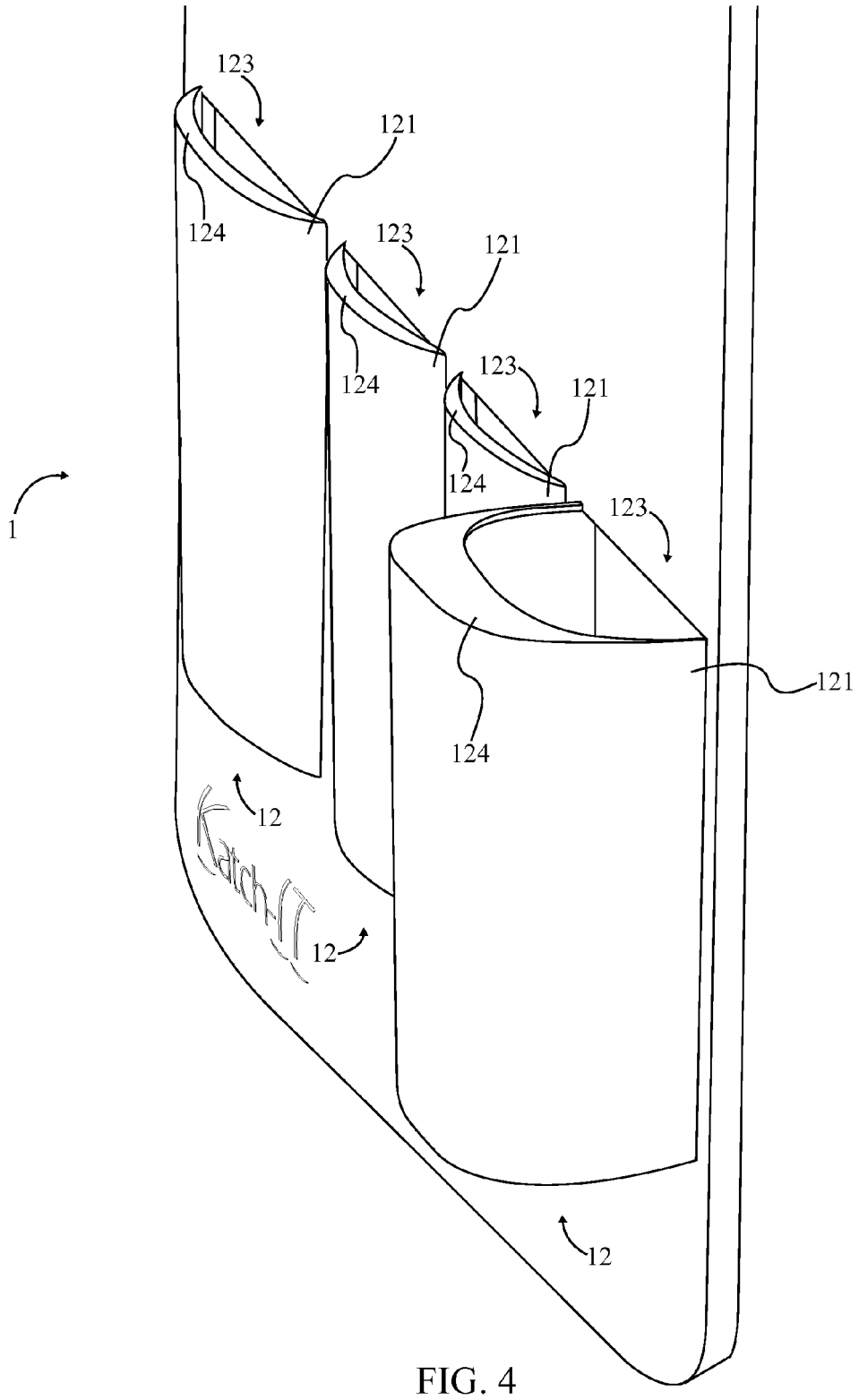
FIG. 4 is another perspective view showing the plurality of pockets of the present invention.
Figure 5:
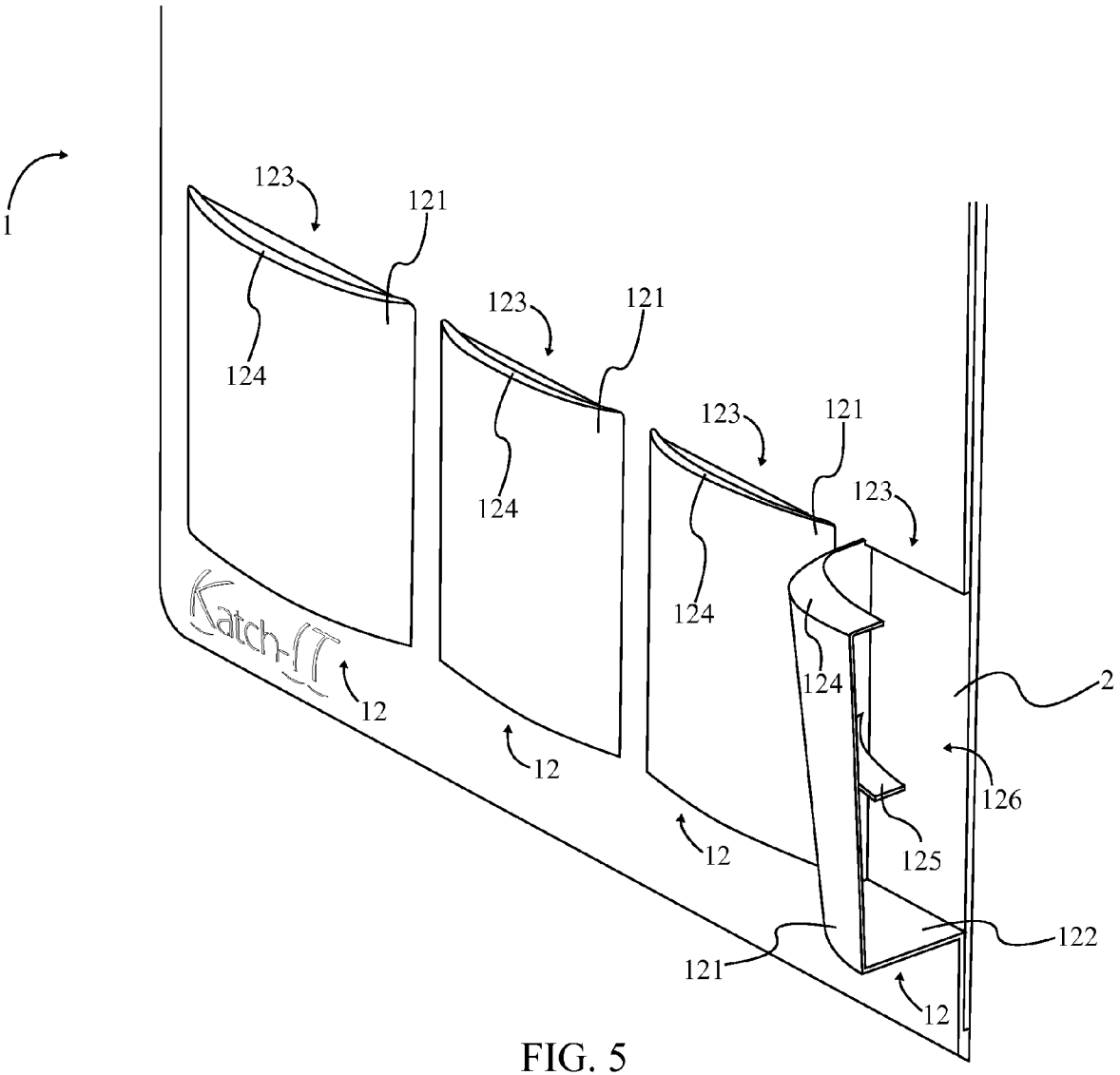
FIG. 5 is a perspective view showing the interior of one of the plurality of pockets of the present invention.

The present invention is a storage apparatus designed for bedside use, such as in a hospital setting, nursing home, or any other situation as needed. For example, though the present invention is described as being used with the railing 6 on a hospital bed, the present invention may also be used with a railing 6 of a wheelchair or even a car. The present invention provides storage for a hospital patient and can be flipped about a bed railing 6, hanging on either the inside or outside of the bed depending on how the railing 6 is rotated. When a railing 6 is in a use (up) position, the present invention can hang on the inside of the railing 6 allowing a patient to access the present invention. When the railing 6 is in a down position, such as for allowing access to the bed, the present invention rotates about the railing 6 to be on the outside of the railing 6 such that the present invention is unobtrusively positioned. The present invention comprises a flexible panel 1, a rigid backplate 2, a first flexible strap 3, and a second flexible strap 4, as illustrated in FIG. 1. The flexible panel 1 and the rigid backplate 2 are connected to each other to form a unitary component. The first flexible strap 3 and the second flexible strap 4 are connected to opposite ends of the flexible panel 1 and allow the flexible panel 1 to be secured to a railing 6 or other similar structure.

Figure 6:
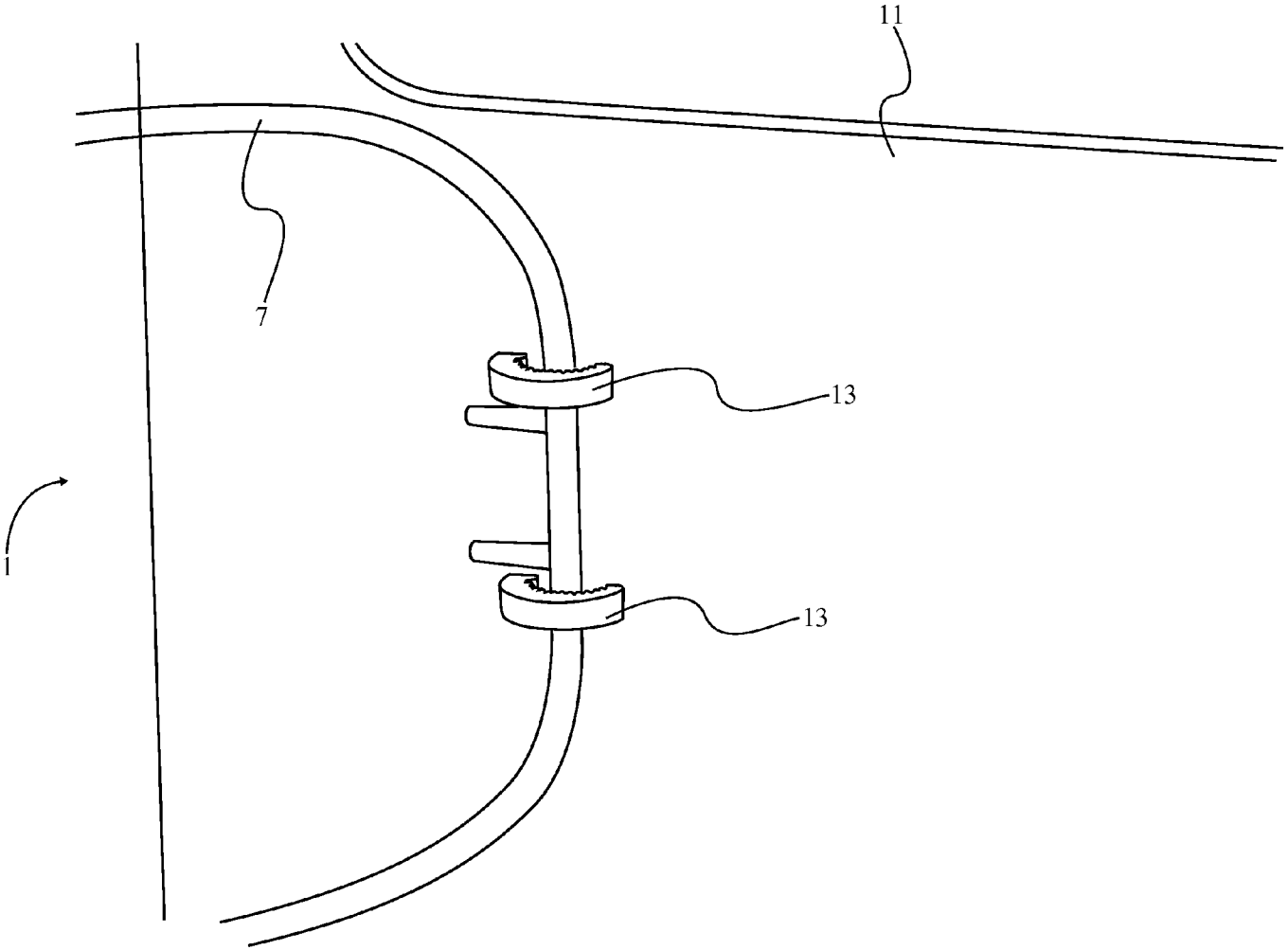
FIG. 6 is an enhanced perspective view showing a plurality of guide rings of the present invention, and an oxygen tube.
Figure 7:
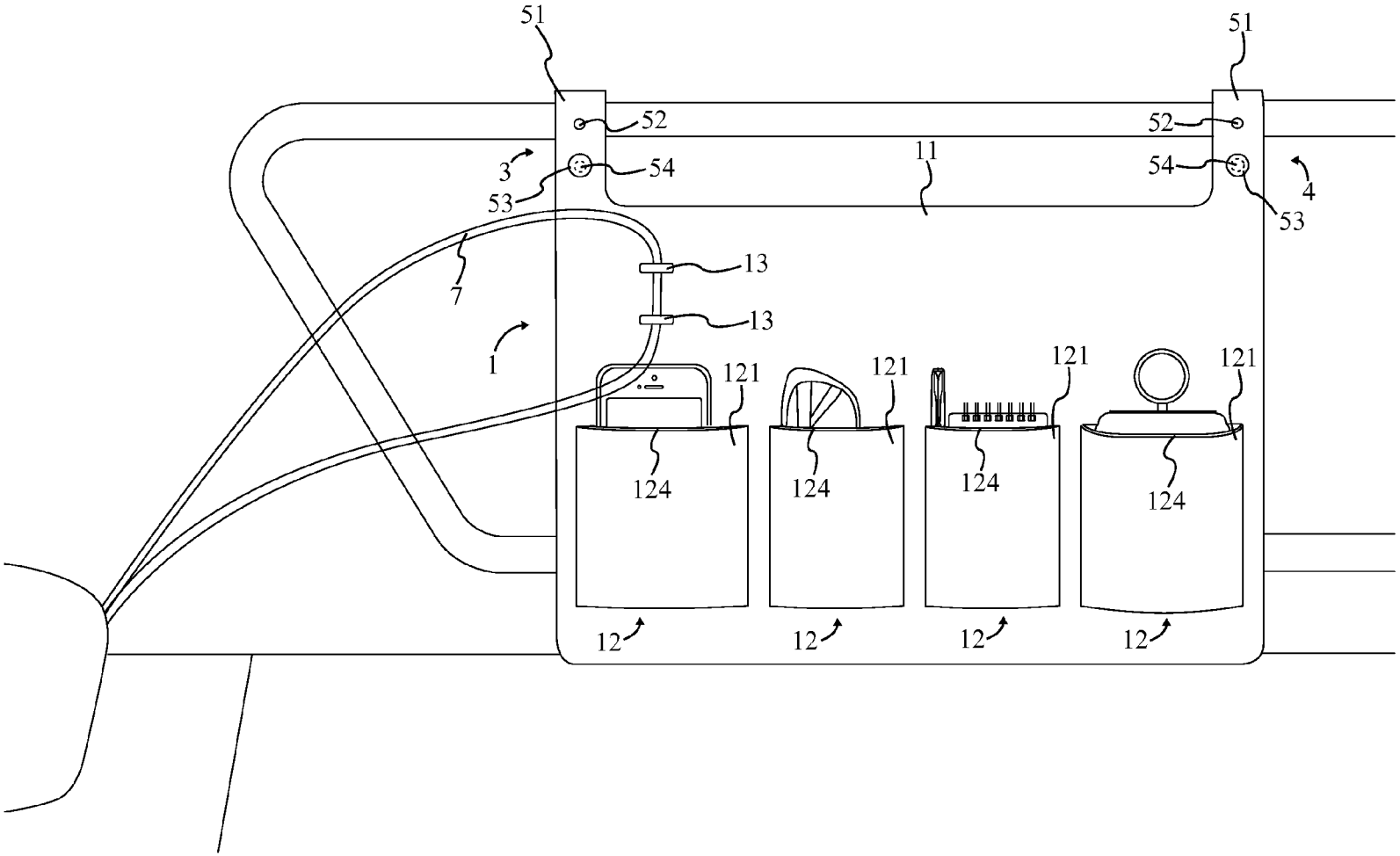
FIG. 7 is a perspective view showing the present invention in use with a hospital bed.
Figure 8:
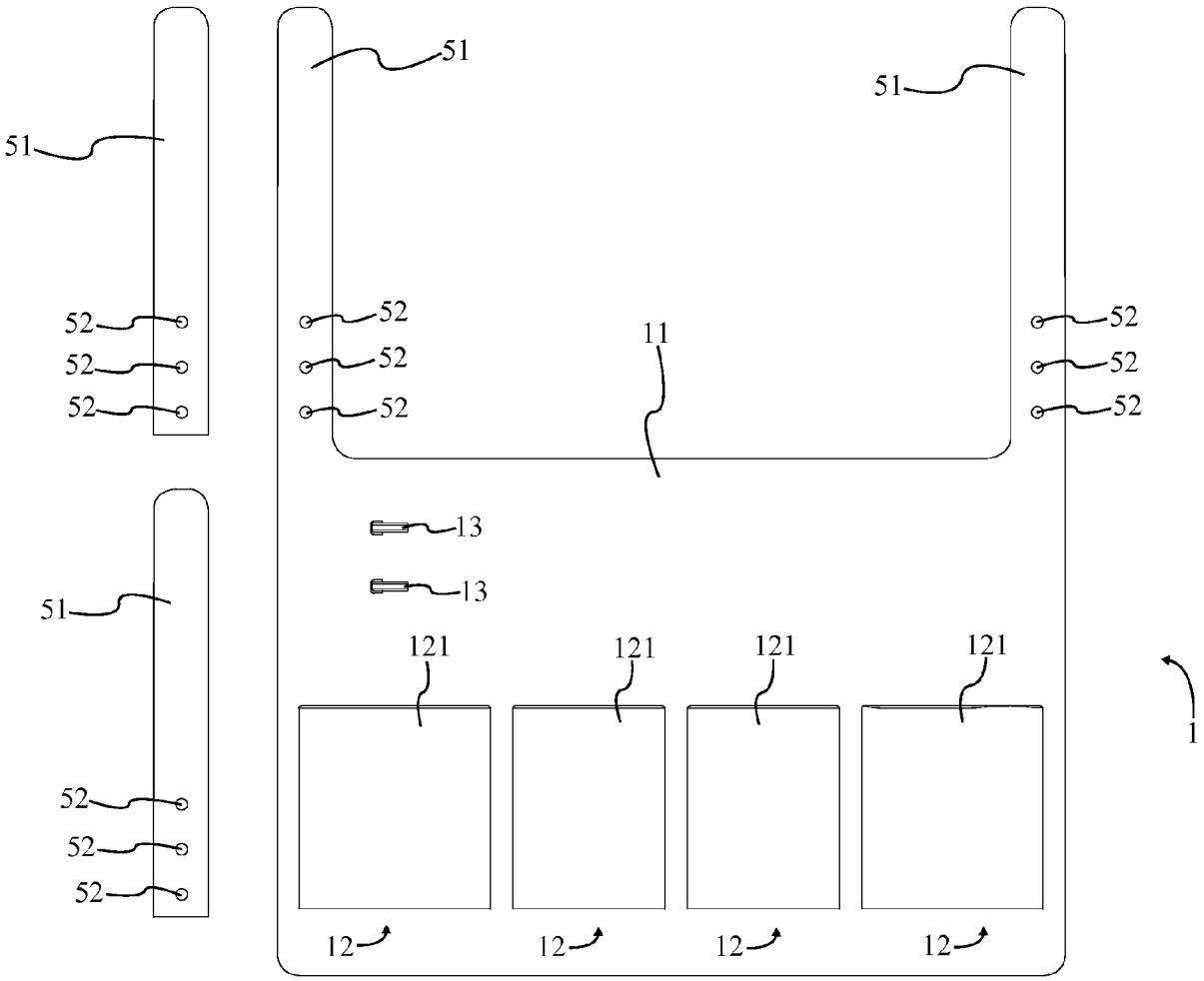
FIG. 8 is a front view diagramming the present invention, as well as potential additional flexible straps.
Figure 9:
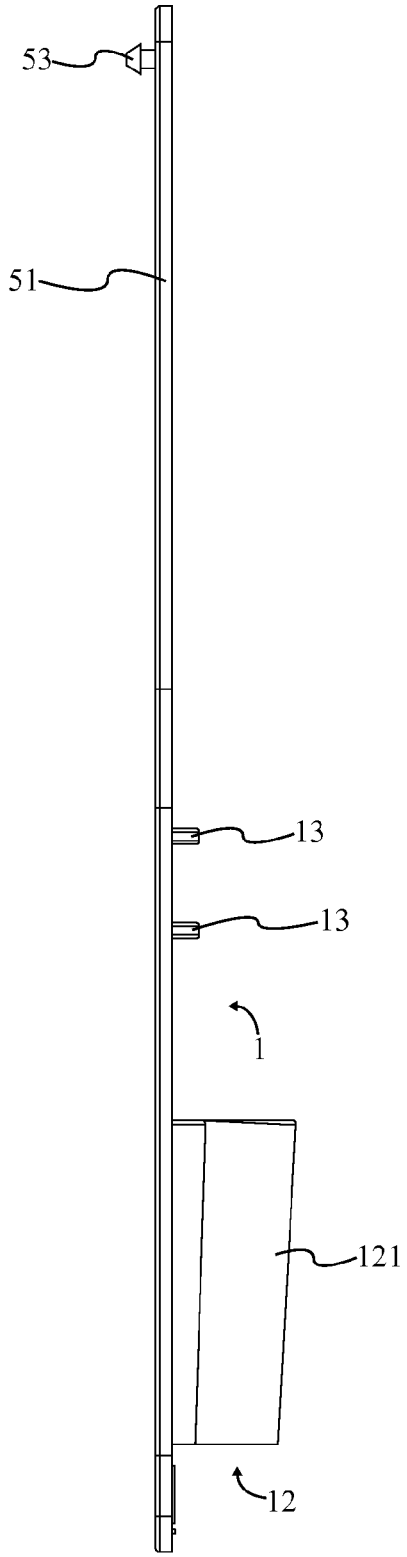
FIG. 9 is a side view diagramming the present invention.
Figure 10:
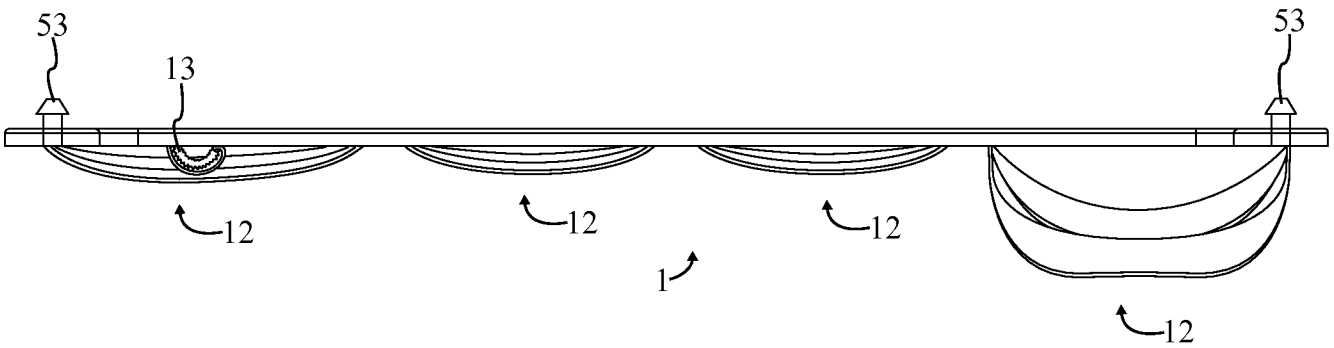
FIG. 10 is a top view diagramming the present invention.

The flexible panel 1, shown in FIG. 1-FIG. 10, comprises a top edge 11, a plurality of pockets 12, and a plurality of guide rings 13. The top edge 11 forms one length of the flexible panel 1, which is rectangular in the preferred embodiment. The plurality of pockets 12 and the plurality of guide rings 13 are positioned on the flexible panel 1. The plurality of guide rings 13 is designed to help hold an oxygen tube 7 when not in use by a patient. The plurality of guide rings 13 is perpendicular to the flexible panel 1, allowing the oxygen tube 7 to be routed through the plurality of guide rings 13 positioned across the flexible panel 1, as seen in FIG. 6 and FIG. 7. Providing structure to the present invention is the rigid backplate 2, which is perimetrically connected to the flexible panel 1, opposite the plurality of pockets 12. This rigid backplate 2, visible in FIG. 1 and FIG. 5, acts as a backing to the flexible panel 1.

The plurality of pockets 12, shown in FIG. 1-FIG. 5 and FIG. 7-FIG. 10, is positioned along the flexible panel 1, parallel to the top edge 11. Each of the plurality of pockets 12 comprises a pocket wall 121, a base 122, an opening 123, an upper lip 124, an interior lip 125, and an item receiving volume 126, as exemplified in FIG. 5. The base 122 is perimetrically connected to the pocket wall 121, as well as being connected perpendicular to the flexible panel 1, forming a bottom surface of the pocket. The pocket wall 121 is connected to the flexible panel 1 and the base 122 such that the item receiving volume 126 is formed between the pocket wall 121, the base 122, and the flexible panel 1. The opening 123 is positioned adjacent to the item receiving volume 126, opposite the base 122. The interior lip 125 and the upper lip 124 are connected to the pocket wall 121, positioned within the item receiving volume 126. The interior lip 125 is connected to the pocket wall 121 between the opening 123 and the base 122, while the upper lip 124 is connected to the pocket wall 121 adjacent to the opening 123.

Allowing the present invention to be secured to a railing 6 are the first flexible strap 3 and the second flexible strap 4, visible in FIG. 1, FIG. 2, and FIG. 7-FIG. 10. The first flexible strap 3 and the second flexible strap 4 are connected to the flexible panel 1. To balance the weight of the flexible panel 1, the first flexible strap 3 and the second flexible strap 4 are positioned opposite each other along the top edge 11. The first flexible strap 3 and the second flexible strap 4 each comprise a strap body 51, a plurality of eyelets 52, and a stud 53. The plurality of eyelets 52 is positioned on and along the strap body 51, adjacent to the top edge 11. Positioned on the strap body 51, opposite the plurality of eyelets 52 along the strap body 51, is the stud 53. The plurality of eyelets 52 forms a series of holes in the strap body 51, similar to the grommets on a tarp. These holes are designed to receive the stud 53, which traverses through one of the holes and thus engages with one of the plurality of eyelets 52. Potentially, additional straps could be included. These extra straps would act as extensions to the first flexible strap 3 and the second flexible strap 4, with the studs 53 of the first flexible strap 3 and the second flexible strap 4 connecting to one of the plurality of eyelets 52 on the additional straps.

The present invention provides convenient bedside storage, such as for hospital patients. Illustrations showing the present invention in use are provided in FIG. 2 and FIG. 7. The present invention is positioned so that the plurality of pockets 12 is adjacent to the patient, with the present invention hanging at the interior side of the railing 6. The first flexible strap 3 and the second flexible strap 4 are designed to bend around the railing 6 of a hospital bed, at which point the stud 53 is engaged with an arbitrary eyelet 54 from the plurality of eyelets 52. Resultantly, the first flexible strap 3 and the second flexible strap 4 form a band around the railing 6, allowing the first flexible strap 3 and the second flexible strap 4 to rotate about the railing 6. This is beneficial as it allows the present invention to be hung from the railing 6 regardless if the railing 6 is in an up position or a down position. When the railing 6 is in an up position the present invention provides a patient with easy access to their belongings, as the railing 6 allows the present invention to hang next to the patient's upper body. However, if health care attendants need to treat the patient or change the bedding, the railing 6 is rotated to a down position so that it does not interfere with the health care attendants in their work. As the railing 6 rotates to a down position, the first flexible strap 3 and the second flexible strap 4 can be rotated about the railing 6 so that the present invention retains an upright orientation even while the railing 6 is in the down position. The first flexible strap 3 and the second flexible strap 4 also serve to prevent the present invention from sliding along the railing 6; even if the patient's bed is angled the present invention will not slide along the railing 6, keeping it in an optimal position. Each of the plurality of pockets 12 is able to hold personal property in the item receiving volume 126, as shown in FIG. 7, providing compact and accessible storage to a patient. The pockets 12 can be used to hold any appropriately sized item, examples of which include cell phones, eye glasses, dentures, and hearing aids. The interior lip 125 and the upper lip 124 hold the stored items inside the pockets 12, preventing items from falling out of the pockets 12 when the present invention is rotated about the railing 6. The plurality of guide rings 13 allow for oxygen tube 7 management, routing the oxygen tube 7 away from the plurality of pockets 12 so that the oxygen tube 7 does not interfere with accessing the pockets 12. The plurality of guide rings 13 provide storage for the oxygen tube 7 when the oxygen tube 7 is not in use. The present invention is lightweight, allowing a patient to hold it with one hand. The design of the first flexible strap 3 and the second flexible strap 4 allows a patient to easily switch the present invention between the left bed railing 6 and the right bed railing 6. This allows the present invention remain easily accessible even when the patient is turned on their side, which is often done as a preventative measure against pressure ulcers.

In the present invention the flexible panel 1 and the rigid backplate 2 can be made from a variety of materials, as long as these materials are suitable to the function of the flexible panel 1 and a rigid backplate 2. Similarly, the first flexible strap 3 and the second flexible strap 4 can be made from any flexible material. The stud 53 is a made as an extrusion on the strap body 51, while the plurality of eyelets 52 is simply formed by cutting holes in the strap body 51. To reinforce the shape of the plurality of eyelets 52, each eyelet may be surrounded by a ring, with the ring providing structure to the eyelet 52. The pockets 12 are preferably rectangular in shape, and number four in total, though in other embodiments the number and shape may vary. The ideal embodiment of the present invention is washable, with the flexible panel 1, first flexible strap 3, second flexible strap 4, and rigid backplate 2 all being tolerant of soap and water.

In other embodiments, the first flexible strap 3 and the second flexible strap 4 utilize a different fastening method than that of the described preferred embodiment. Instead of using a stud 53 and plurality of eyelets 52, the straps may utilize other components that provide the same functionality. For example, the stud 53 may be replaced by hook-and-loop fasteners, a snap fastener, or a tongue. Correspondingly, the plurality of eyelets 52 may be replaced by hook-and-loop fasteners, snap fastener receptacles, or a buckle. Though these alternate embodiments replace the stud 53 and plurality of eyelets 52 from the preferred embodiment, they still allow the first flexible strap 3 and the second flexible strap 4 to secure to a railing 6, as required for the function of the present invention. As described earlier, in other embodiments additional straps may also be provided. These additional straps also comprise a strap body 51, a plurality of eyelets 52, and a stud 53, and can be attached to the first flexible strap 3 and second flexible strap 4 to extend the length of the straps. This works by engaging the studs 53 of the additional straps to one of the plurality of eyelets 52 of the first flexible strap 3 and second flexible strap 4.

Although the invention has been explained in relation to its preferred embodiment, it is to be understood that many other possible modifications and variations can be made without departing from the spirit and scope of the invention as hereinafter claimed.

What is claimed is:

1. A bedside storage caddy comprises:

a flexible panel;

a rigid backplate;

a first flexible strap;

a second flexible strap;

the rigid backplate being perimetrically connected to the flexible panel;

the first flexible strap and the second flexible strap being connected to the flexible panel;

the flexible panel comprises a top edge, a plurality of pockets, and a plurality of guide rings;

the first flexible strap and the second flexible strap each comprise a strap body, a plurality of eyelets, and a stud;

the first flexible strap and the second flexible strap being positioned adjacent to the top edge;

the first flexible strap and the second flexible strap being positioned opposite each other along the top edge;

the plurality of eyelets being positioned on the strap body;

the stud being positioned on the strap body;

the plurality of eyelets being positioned adjacent to the top edge;

the plurality of eyelets being serially positioned along the strap body;

the stud being positioned opposite the plurality of eyelets along the strap body;

the stud being engaged with an arbitrary eyelet from the plurality of eyelets, wherein the first flexible strap and the second flexible strap wrap around a railing;

the rigid backplate being positioned adjacent to the flexible panel;

the plurality of pockets being positioned across the flexible panel;

the plurality of pockets being positioned opposite the rigid backplate;

each of the plurality of pockets comprises a pocket wall, a base, an opening, an upper lip, an interior lip, and an item receiving volume;

the base being perimetrically connected to the pocket wall;

the pocket wall being connected to the flexible panel;

the base being connected perpendicular to the flexible panel;

the item receiving volume being positioned between the pocket wall, the base, and the flexible panel;

the opening being positioned adjacent to the item receiving volume opposite the base;

the upper lip being positioned between the pocket wall and the flexible panel;

the upper lip being connected to the pocket wall adjacent to the opening;

the interior lip being positioned in the item receiving volume between the base and the upper lip; and the interior lip being connected to the pocket wall.

2. The bedside storage caddy as claimed in claim 1 comprises:

the plurality of guide rings being connected perpendicular to the flexible panel, wherein the plurality of guide rings restrain a tube.

3. A bedside storage caddy comprises:

a flexible panel;

a rigid backplate;

a first flexible strap;

a second flexible strap;

the rigid backplate being perimetrically connected to the flexible panel;

the first flexible strap and the second flexible strap being connected to the flexible panel;

the flexible panel comprises a top edge, a plurality of pockets, and a plurality of guide rings;

the first flexible strap and the second flexible strap each comprise a strap body, a plurality of eyelets, and a stud;

the first flexible strap and the second flexible strap being positioned adjacent to the top edge;

the first flexible strap and the second flexible strap being positioned opposite each other along the top edge;

the plurality of pockets being positioned across the flexible panel; each of the plurality of pockets comprises a pocket wall, a base, an opening, an upper lip, an interior lip, and an item receiving volume;

the rigid backplate being positioned adjacent to the flexible panel;

the plurality of guide rings being connected perpendicular to the flexible panel, wherein the plurality of guide rings restrain a tube;

the plurality of pockets being positioned opposite the rigid backplate;

the base being perimetrically connected to the pocket wall;

the pocket wall being connected to the flexible panel;

the base being connected perpendicular to the flexible panel;

the item receiving volume being positioned between the pocket wall, the base, and the flexible panel;

the opening being positioned adjacent to the item receiving volume opposite the base;

the upper lip being positioned between the pocket wall and the flexible panel;

the upper lip being connected to the pocket wall adjacent to the opening;

the interior lip being positioned in the item receiving volume between the base and the upper lip; and the interior lip being connected to the pocket wall.

4. The bedside storage caddy as claimed in claim 3 comprises:

the plurality of eyelets being positioned on the strap body;

the stud being positioned on the strap body;

the plurality of eyelets being positioned adjacent to the top edge;

the plurality of eyelets being serially positioned along the strap body;

the stud being positioned opposite the plurality of eyelets along the strap body; and the stud being engaged with an arbitrary eyelet from the plurality of eyelets, wherein the first flexible strap and the second flexible strap wrap around a railing.

5. A bedside storage caddy comprises:

a flexible panel;

a rigid backplate;

a first flexible strap;

a second flexible strap;

the rigid backplate being perimetrically connected to the flexible panel;

the first flexible strap and the second flexible strap being connected to the flexible panel;

the flexible panel comprises a top edge, a plurality of pockets, and a plurality of guide rings;

the first flexible strap and the second flexible strap each comprise a strap body, a plurality of eyelets, and a stud;

the first flexible strap and the second flexible strap being positioned adjacent to the top edge;

the first flexible strap and the second flexible strap being positioned opposite each other along the top edge;

the plurality of eyelets being positioned adjacent to the top edge;

the stud being positioned opposite the plurality of eyelets along the strap body;

the stud being engaged with an arbitrary eyelet from the plurality of eyelets, wherein the first flexible strap and the second flexible strap wrap around a railing;

the plurality of pockets being positioned across the flexible panel;

each of the plurality of pockets comprises a pocket wall, a base, an opening, an upper lip, an interior lip, and an item receiving volume;

the base being perimetrically connected to the pocket wall;

the pocket wall being connected to the flexible panel;

the base being connected perpendicular to the flexible panel;

the item receiving volume being positioned between the pocket wall, the base, and the flexible panel;

the opening being positioned adjacent to the item receiving volume opposite the base;

the plurality of eyelets being positioned on the strap body;

the stud being positioned on the strap body;

the plurality of eyelets being serially positioned along the strap body;

the plurality of guide rings being connected perpendicular to the flexible panel, wherein the plurality of guide rings restrain a tube;

the plurality of pockets being positioned opposite the rigid backplate;

the upper lip being positioned between the pocket wall and the flexible panel;

the upper lip being connected to the pocket wall adjacent to the opening;

the interior lip being positioned in the item receiving volume between the base and the upper lip; and the interior lip being connected to the pocket wall.

6. The bedside storage caddy as claimed in claim 5 comprises:

the rigid backplate being positioned adjacent to the flexible panel.

* * * * *